US010458628B2

(12) United States Patent
Vidal et al.

(10) Patent No.: US 10,458,628 B2
(45) Date of Patent: Oct. 29, 2019

(54) LED LUMINAIRE WITH ADAPTABLE INSTALLATION KIT

(71) Applicant: GREEN CREATIVE, LTD, Hong Kong (CN)

(72) Inventors: Guillaume Vidal, Mende (FR); Zhang Yulin, Shanghai (CN)

(73) Assignee: Green Creative Ltd., Hong Kong (CN)

( * ) Notice: Subject to any disclaimer, the term of this patent is extended or adjusted under 35 U.S.C. 154(b) by 0 days.

(21) Appl. No.: 15/932,764

(22) Filed: Apr. 23, 2018

(65) Prior Publication Data

US 2018/0313524 A1 Nov. 1, 2018

Related U.S. Application Data

(60) Provisional application No. 62/602,525, filed on Apr. 26, 2017.

(51) Int. Cl.

| | |
|---|---|
| ***F21V 21/04*** | (2006.01) |
| ***F21V 23/06*** | (2006.01) |
| ***F21V 23/00*** | (2015.01) |
| ***F21Y 115/10*** | (2016.01) |
| ***F21Y 105/10*** | (2016.01) |

(52) U.S. Cl.

CPC ..... *F21V 21/04* (2013.01); *F21V 23/009* (2013.01); *F21V 23/06* (2013.01); *F21Y 2105/10* (2016.08); *F21Y 2115/10* (2016.08)

(58) Field of Classification Search

CPC ..... F21V 21/04; F21V 21/042; F21V 23/009; F21V 23/06; F21Y 2105/10; F21Y 2115/10

See application file for complete search history.

(56) References Cited

U.S. PATENT DOCUMENTS

| | | | | |
|---|---|---|---|---|
| 9,618,678 | B1 * | 4/2017 | Tickner | G02B 6/0085 |
| 10,132,477 | B1 * | 11/2018 | Winters | F21V 17/166 |
| 10,247,399 | B1 * | 4/2019 | Winters | F21V 23/026 |
| 2015/0198324 | A1 * | 7/2015 | O'Brien | F21V 33/0052 362/294 |
| 2019/0063700 | A1 * | 2/2019 | Lawrence | F21S 8/024 |

* cited by examiner

*Primary Examiner* — Mary Ellen Bowman

(74) *Attorney, Agent, or Firm* — James A. Gavney, Jr.; JAG Patent Services

(57) ABSTRACT

The LED lighting system is disclosed that includes an LED light fixture with slip tabs and/or snap or spring clips and an installation kit. The installation kit includes a set of hook clips at couple to the slip tabs, a junction box face-plate and a junction box unit with arm flanges that couple to the snap or spring clips. The installation kit allows the same LED light fixture be used in, or adapted for, a number of different installation configurations.

14 Claims, 4 Drawing Sheets

LED LUMINAIRE WITH ADAPTABLE INSTALLATION KIT

RELATED APPLICATION

This application is a continuation-in-part of co-pending U.S. patent application Ser. No. 15/330,142, filed on Aug. 15, 2016, and titled "LED LIGHT FIXTURE WITH ADJUSTABLE MOUNTING MECHANISM". This application claims priority under 35 U.S.C. § 119(e) from the U.S. provisional patent application Ser. No. 62/602,525, filed on Apr. 26, 2017, and titled "DOWN-LIGHT LUMINAIRE SYSTEM." The U.S. patent application Ser. No. 15/330,142, filed on Aug. 15, 2016, and titled "LED LIGHT FIXTURE WITH ADJUSTABLE MOUNTING MECHANISM" and the provisional patent application Ser. No. 62/602,525, filed on Apr. 26, 2017, and titled "DOWN-LIGHT LUMINAIRE SYSTEM" are both hereby incorporated by reference.

FIELD OF THE INVENTION

This invention relates to recessed lighting. More particularly, the present invention relates to recessed LED lighting system.

BACKGROUND OF THE INVENTION

The light fixtures commonly installed on the ceiling or walls of living spaces and work spaces, are often mounted to electrical connections through can or canister structure and/or electrical junction boxes. These fixtures often use incandescent light bulbs or fluorescent light bulbs. Because LED light fixtures are more efficient than incandescent or fluorescent light fixtures, it is desirable to convert or replace these incandescent or fluorescent light fixtures to LED light fixtures or install new LED light fixtures where incandescent or fluorescent light fixtures normally would be used. Usually, converting, replacing or installing new LED light fixtures requires different sets of hardware and different installation kits.

SUMMARY OF INVENTION

The present invention is directed to an LED light system. The LED lighting system includes a LED light fixture. The LED light fixture has a flattened body with a top surface and a bottom surface with an array of LEDs. The arrays of LEDs can be positioned on the bottom surface of the flattened body, around edges of the flattened body or a combination thereof. The LED light fixture further includes an LED driver circuit. The LED driver circuit can be contained within a housing. For example the LED light fixture can include a rectangular LED driver box housing and LED driver circuit electrically coupled to the array of LEDs positioned on the top surface of the flattened body. The LED light fixture also has snap or spring clip structures protruding upward form the top surface of the flattened body and along two opposed sides of the LED driver box housing.

The LED light system also includes an installation kit. In accordance with an embodiment of the invention the installation kit includes a junction box face-plate with sets of elongated and curved fenestrations or cutouts. The curved fenestrations or cutouts allow the junction box face-plate to be coupled to variety of different junction boxes. The junction box face-plate also has a semi-rectangular cutout with tab indentations. In accordance with an embodiment of the invention, the semi-rectangular cut-out allows the LED driver box to pass through the semi-rectangular cutout with the snap or spring clip structures engaged with the tab indentations, thereby securing the LED light fixture onto the junction box. The LED driver circuit and/or the LED driver box can have any suitable shape or position on the LED light fixture.

In a further embodiments of the invention, the insulation kit further includes a sets of slip tabs positioned on the top surface of the flattened body and surrounding the LED driver box. In accordance with this embodiments of the invention the installation kit also includes a set of hook clips each having an elongated body with an L-shaped bottom portion and a top curved hook structure bending in an opposite direction relative to the L-shaped bottom portion. In operation the L-shaped bottom portion of the hook clips slide under or into portions of the slip tabs and the top curved hook structures are used to engaged and secure the LED light fixture into a recessed light canister housing.

In yet further embodiments of the invention the kit further comprises a junction box unit. The junction box unit includes an electrical box having a bottom portion that includes side plates forming a semi-rectangular aperture with tab indentations. In operation the LED driver box is passed through the semi-rectangular aperture with the snap or spring clip structures engaged with the tab indentations, thereby securing the LED light fixture onto the electrical box of the junction box unit. The junction box unit further includes arm flanges that are hingably attached to opposed sides of the electrical box. With the arm flanges folded upward, the arm flanges and the electrical box are passed through a recess hole on a ceiling or wall and the arm flanges are folded downward, thereby securing the LED light fixture in place.

The embodiments of the installation kit described above and below allow a LED light fixture be installed into a canister of an existing recessed lighting fixture, to connected to an new or existing junction box and to be installed in new or existing construction. The LED light fixture preferably includes a diffuser lens positioned over the array of LEDs. Also, the flattened body of the LED light fixture is preferably round and the LED driver box has quick connect features for electrically coupling the LED light fixture to power wiring.

DETAILED DESCRIPTION

Figure 1A:
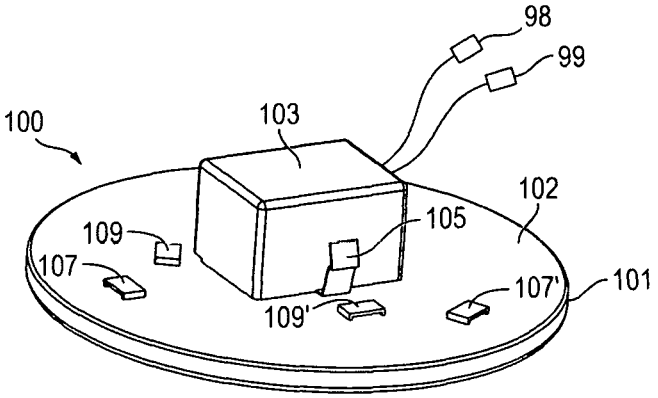
FIGS. 1A-D show views of an LED light fixture with snap or spring clips and slip tabs for installing the LED light fixture with an adaptable installation kit, in accordance with the embodiments of the invention.
Figure 1B:
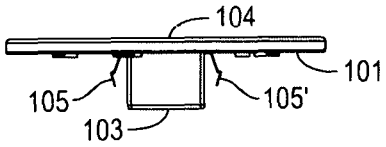
Figure 1C:
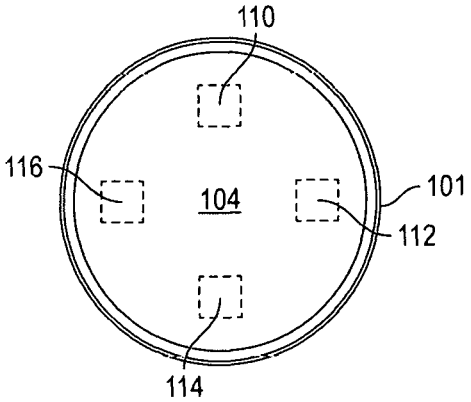
Figure 1D:
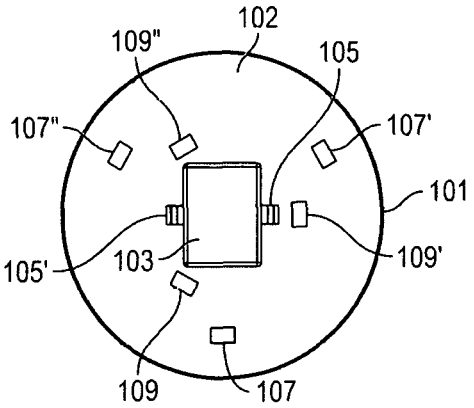

Referring to FIGS. 1A-D, the present invention is directed to an LED lighting system that includes and LED light fixture 100. The LED light fixture 100 has a flattened body that is preferably a round or disk shaped body 101. While the flattened body of the light fixture is described as round or disk shaped, it will be clear to one skilled in the art that the light fixture body can have any number of shapes including, but not limited to, square, triangle and rectangular shapes.

On a top surface 102 of the round or disk shaped body 101 of the LED light fixture 100 there is a rectangular LED diver box 103 with connections 98 and 99. The LED diver box 103 houses an LED driver circuit that powers an array of LEDs 110, 112, 114 and 116 coupled to a bottom surface of the round or disk shaped body 101 of the LED light fixture 100.

The connectors 98 and 99 are configured to couple to existing or new wiring to power the array of LEDs through the LED driver circuit housed within the LED diver box 103. The connections 98 and 99 couple to existing or new wiring through, for example, quick connect features or using standard wire nut techniques. The array of LEDs 110, 112, 114 and 116 are mounted to a printed circuit board and is preferably covered by a diffuser lens 104.

On two opposed sides of rectangular LED driver box 103 and protruding upward from the top surface 102 of the round or disk shaped body 101 of the LED light fixture 100 are a set of snap or spring clip structures 105 and 105'. Arranged around a first circumference on the top surface 102 of the round or disk shaped body 101 of the LED light fixture 100 there is a first set of slip tabs 107, 107' and 107" and around a second and smaller circumference on the top surface 102 of the round or disk shaped body 101 of the LED light fixture 100 there is second set of slip tabs 109, 109' and 109".

Figure 2A:
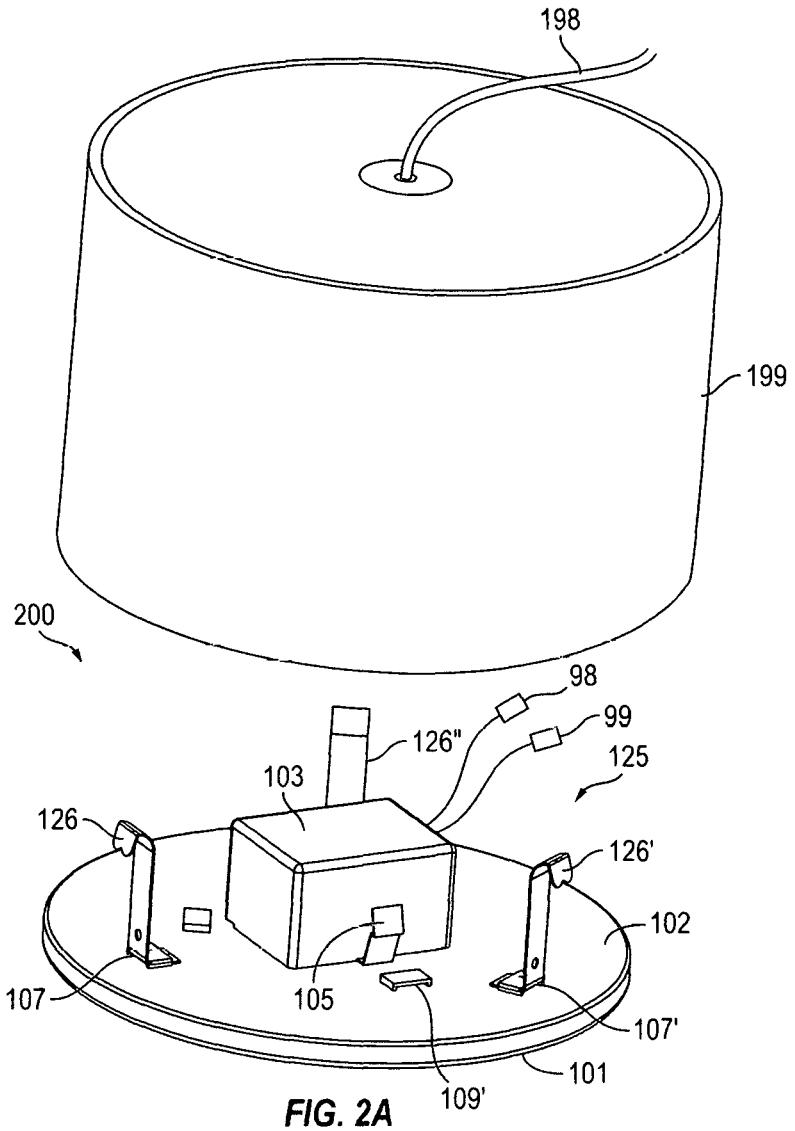
FIGS. 2A-B show views the LED light fixture and clips structures that couple to a top surface of the LED light fixture for installing the LED light fixture into an canister housing of a recessed light fixture, in accordance with the embodiments of the invention.
Figure 2B:
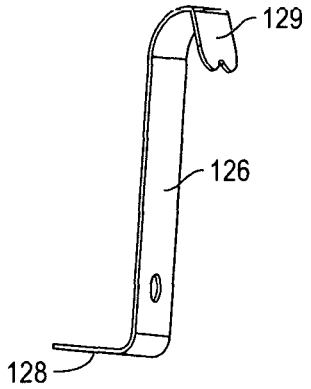

Referring now to FIGS. 2A-B, the installation kit of the present invention includes three or more hook clips 126, 126' and 126" that allows the LED light fixture to be installed into a canister housing 199 of an existing recessed lighting fixture. The LED light fixture used with the installation kit with the hook clips 126, 126' and 126" is an LED light fixture with a round or disk shaped body 101, sets of slip tabs 107, 107' and 107" and 109, 109' and 109", an LED driver box 103 with connectors 98 and 99, an array of LEDs 110, 112, 114 and 116 (FIG. 1C), a diffuser lens (FIG. 1C) and set of snap or spring clip structures 105 and 105', such as described above.

The hook clips 126, 126' and 126" each have and elongated body with an L-shaped bottom portion 128 and a top curved hook structure 129 that bends in an opposite direction relative to the L-shaped bottom portion 128. In operation the L-shaped bottom portions 128 of the hook clips 126, 126' and 126" are placed into a first set of slips tabs as shown, with the top hook portions facing outward from the corresponding first circumference of the first set slip tabs 107, 107' and 107". With the hook clips coupled to the slip tabs 107, 107' and 107" as shown, the assembled light fixture 200 can be wired to existing wiring 198 in the existing canister housing 199 and securely fitting into the existing canister housing 199 of a recessed lighting fixture.

In an alternative configuration, the L-shaped bottom portions 128 of the hook clips 126, 126' and 126" are placed into the second set slips tabs 109, 109' and 109", again with the top hook portions facing outward from the corresponding second circumference of the second set slip tabs 109, 109' and 109". With the hook clips coupled to the second set of slip tabs 109, 109' and 109", the assembled light fixture 200 can be wired to existing wiring 198 in the existing canister housing 199 and securely fitting into the existing canister housing 199 of a recessed lighting fixture.

The canister installation kit with the hook clips hook clips 126, 126' and 126", as described above, can be used to install the same LED light fixture 100 (FIG. 1A) with two different sizes of existing recessed lighting canister housings. It will be clear to one skilled in the art that the LED light fixture 100 can include additional sets of slip tabs and/or include adjustable slip tabs to accommodate wide range of recessed lighting canister housing sizes including, but not limited to, 4, 5 or 6 inch recessed lighting canister housings.

Figure 3A:
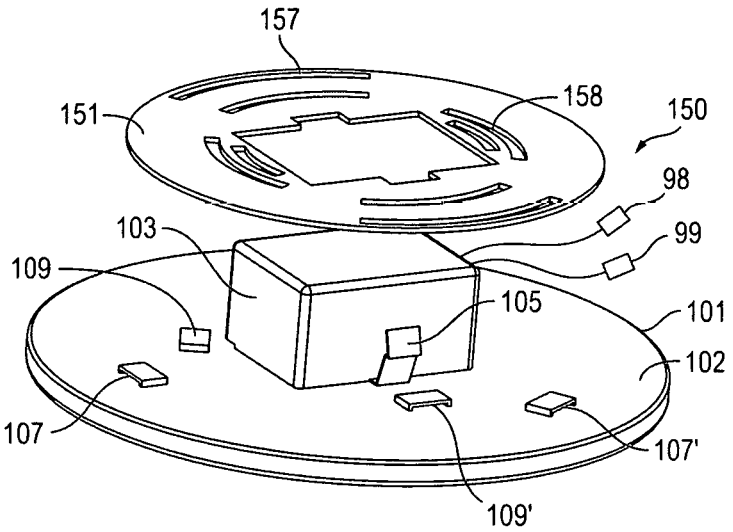
FIGS. 3A-C show views the LED light fixture and a junction box face-plate structure that couples to the LED light fixture for installing the LED light fixture onto a junction box, in accordance with the embodiments of the invention.
Figure 3B:
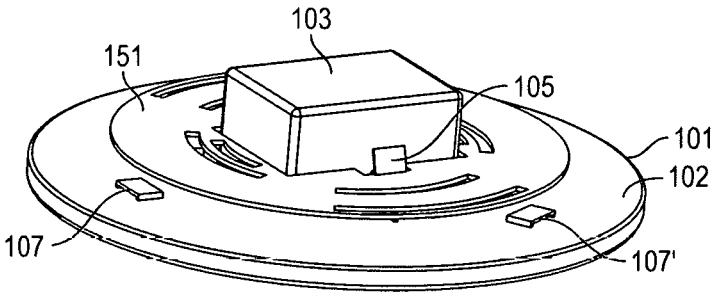
Figure 3C:
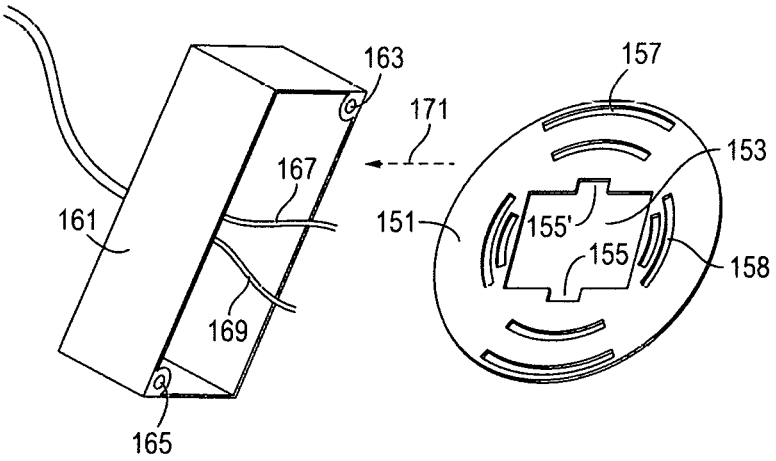
Figure 4A:
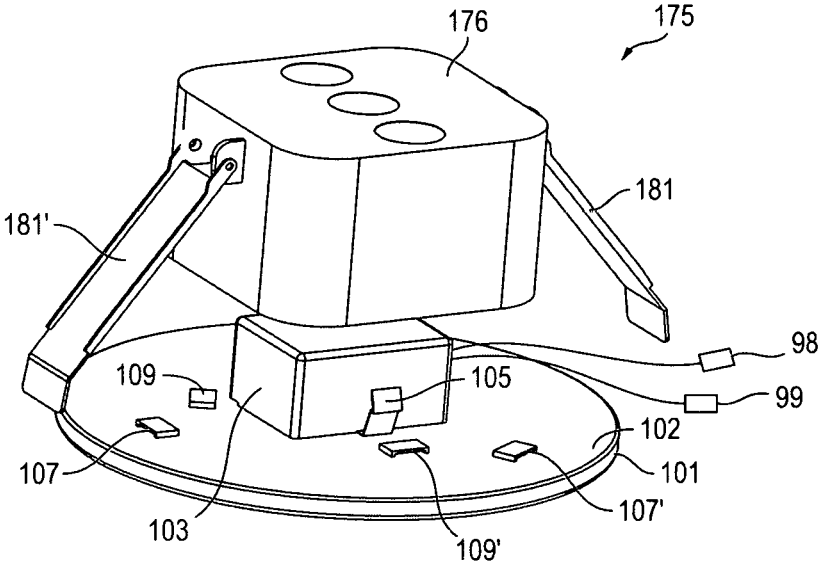
FIGS. 4A-D show views of the LED light fixture and a junction box unit with arm flanges that couples to the LED light fixture for installing the LED light fixture into a recess hole on a ceiling or wall, in accordance with the embodiments of the invention.
Figure 4B:
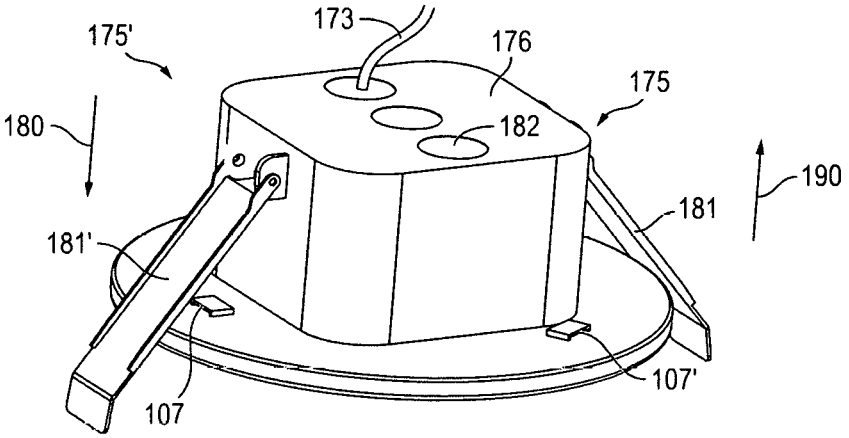
Figure 4C:
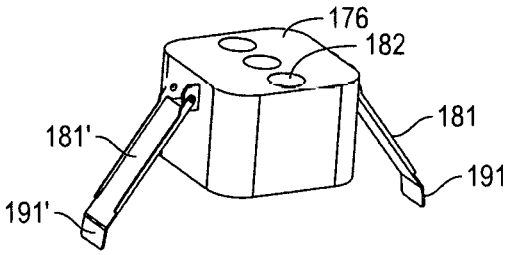
Figure 4D:
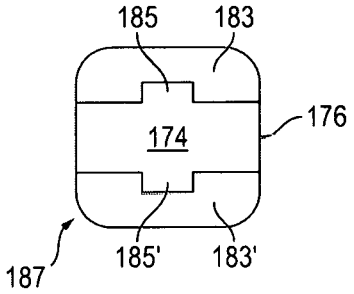

Referring to FIGS. 3A-C, the installation kit of the present invention also includes a junction box face-plate 151. The junction box face-plate 151 is preferably round but can have any number of shapes. The junction box face-plate 151 allows the LED light fixture to be installed onto a large number of different sized existing or new junction boxes.

The installation kit with the junction box face-plate 151 is used to install an LED light fixture that includes round or disk shaped body 101, sets of slip tabs 107, 107' and 107" and 109, 109' and 109", an LED driver box 103 with connectors 98 and 99, an array of LEDs 110, 112, 114 and 116 (FIG. 1C) a diffuser lens (FIG. 1C) and set of snap or spring clip structures 105 and 105', such as described above.

The junction box face-plate 151 includes sets of elongated and curved fenestrations or cutouts 157 and 158. The sets of elongated and curved fenestrations or cutouts 157 and 158 are configured to couple the junction box face-plate 151 to a variety of different junction boxes 161 with different shapes and sizes through, for example, screws that pass through portions of the elongated and curved fenestrations or cutouts 157 and 158 and that engage screw receptacles 163 and 165 on the junction box 161. The junction box face-plate 151 includes a semi rectangular cutout 153 with tab indentations 155 and 155'. In operation, the junction box face-plate is coupled to an existing or new junction box 163, as described above. The LED light fixture is wired to power wires 167 and 169 through connectors 98 and 99 that are electrically coupled to the LED driver circuit within the LED driver box 103. Then the led light fixture 100 (FIG. 1A) is coupled to the junction box face-plate 151 by passing the LED driver box 103 through the semi-rectangular cutout 153 with the top surface 102 of the LED light fixture 100 adjacent to a bottom surface of the junction box face-plate 151. The light fixture 100 is pushed against the junction box face-plate such that the snap or spring clip structures 105 and 105' engage the tab indentations 155 and 155', thereby securing the LED light fixture 100 onto the junction box 161.

Referring to FIGS. 4A-D, in further embodiments of the invention the installation kit includes a junction box unit 175. The junction box unit 175 includes an electrical box 176 with arm flanges 181 and 181' attached to opposed sides of the electrical box 176. The junction box unit 175 is used to install an LED light fixture 100 (FIG. 1A) into an new installation location on a ceiling or wall of new or existing construction. The LED light fixture 100 used includes a round or disk shaped body 101, sets of slip tabs 107, 107' and 107" and 109, 109' and 109", an LED driver box 103 with connectors 98 and 99, an array of LEDs 110, 112, 114 and 116 (FIG. 1C), a diffuser lens (FIG. 1C) and set of snap or spring clip structures 105 and 105', such as described above.

The arm flanges 181 and 181' are preferably spring arm flanges that keep tension in a down ward direction, as indicated by the arrow 180. On a top surface of the electrical box 176, there are punch tabs 182 that can be removed to allow electrical power lines 173 to pass into the electrical box 176. The bottom portion 187 of the electrical box 176 includes sides plates 183 and 183' with tab indentations 185 and 185'. In operation one or more of the punch out tabs 182 are removed and the junction box unit 175 is placed into a recess hole on a ceiling or wall. Then an electrical power line 173 is passed through an aperture created by removing one of the punch out tabs 182. After the electrical box unit 175 is wired, the LED light fixture 100 (FIG. 1A) is couples to the power line 173 through connections 98 and 99 and the LED light fixture 100 is fitted with the LED driver box 103 positioned in the rectangular aperture 174 between the side plates 183 and 183' and pushed against the side plates 183 and 183', such that the snap or spring clip structures engage the tab indentations 185 and 185' thereby securing the LED light fixture onto the junction box unit 175.

Alternatively, the LED light fixture 100 (FIG. 1A) can be completely wired to the power line 173 and coupled to the junction box unit, as described above, prior to stalling the junction box unit 175 and the LED light fixture 100 into the recessed hole on a ceiling or wall. In this case, the LED light fixture 100 is wired to the power line 173 and with the LED light fixture attached to the junction box unit 175 to form an assembled LED light unit 175'. Then the spring flange arms 181 and 181' are lifted upwards, as indicated by the arrow 190, and the junction box unit 175 is passed through the recessed hole on the ceiling or the wall along with the electrical box 176. Then the flange arms 181 and 181' are releases and allowed to collapse or spring downward, as indicated by the arrow 180 and sandwich portions of the ceiling or wall between the ends 191 and 191' of the arm flanges 181 and 181' and the top surface 102 of the body 101 of the LED light fixture 100, thereby securing the LED light fixture in place.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention. For example, the LED driver circuit and/or the LED driver box can have any suitable shape or position on the LED light fixture and is not limited to a rectangular shape. Also, the array of LEDs can be positioned on any suitable surface of the LED light fixture including, but not limited to edges of the flattened body portion of the LED light fixture.

What is claimed is:

1. A LED light system comprising:

a) a LED light fixture comprising:
- i) a flattened body with a top surface and a bottom surface;
- ii) a LED driver circuit within a LED driver box;
- iii) an array of LEDs electrically coupled to the LED driver circuit and positioned on or around the bottom surface of the flattened body; and
- iv) snap or spring clip structures protruding upward from the top surface of the flattened body and along two opposed sides of the LED driver box; and b) an installation kit comprising:
- i) a junction box face-plate with sets of elongated and curved fenestrations or cutouts for coupling to a junction box and a cutout with tab indentations that allow the snap or spring clip structures to engage the tab indentations, thereby securing the LED light fixture onto the junction box;
- ii) sets of slip tabs on the top surface of the flattened body and surrounding the LED driver box; and
- iii) a set of hook clips each having an elongated body with and L-shaped bottom portion and a top curved hook structure that bends in an opposite direction relative to the L-shaped bottom portion, wherein the L-shaped bottom portion fits into portions of the slip tabs such that the top curved hook structure engages a recessed light canister housing to secure the LED light fixture thereto.

2. The LED light system of claim 1, wherein the installation kit further comprises a junction box unit with an electrical box having a bottom portion including side plates that form a semi-rectangular aperture with tab indentations to allow the LED driver box to pass through the semi-rectangular aperture with the snap or spring clip structures engaging the tab indentations, thereby securing the LED light fixture onto the electrical box, the junction box unit further comprising arm flanges that are hingably attached to opposed sides of the electrical box and configured to pass through a recess hole on a ceiling or a wall and thereby securing the LED light fixture in place by sandwiching portions of the ceiling or wall around the recessed hole between ends of the flange arms and portions of the top surface of the flattened body.

3. The LED light system of claim 1, further comprising a diffuser lens positioned over the array of LEDs.

4. The LED light system of claim 1, wherein the flattened body of the LED light fixture is round and the LED driver box includes quick connect features for electrically coupling the LED light fixture to power wiring.

5. A LED light system comprising:

a) a LED light fixture comprising:
- i) a flattened body with a top surface and a bottom surface;
- ii) a LED driver circuit;
- iii) sets of slip tabs on the top surface of the flattened body;
- iv) an array of LEDs electrically coupled to the LED driver circuit and positioned on the bottom surface of the flattened body; and
- v) snap or spring clip structures protruding upward from the top surface of the flattened body; and b) an installation kit comprising a set of hook clips each having an elongated body an L-shaped bottom portion and a top curved hook structure that bends in an opposite direction relative to the L-shaped bottom portion, wherein the L-shaped bottom portion fits into portions of the slip tabs such that the top curved hook structure engages a recessed light canister housing to secure the LED light fixture thereto.

6. The LED light system of claim 5, wherein the insulation kit further comprises a junction box face-plate with sets of elongated and curved fenestrations or cutouts for coupling to a junction box and a semi rectangular cutout with tab indentations that allows the LED driver circuit to pass through the semi-rectangular cutout with the snap or spring clip structures engaging the tab indentations, thereby securing the LED light fixture onto the junction box.

7. The LED light system of claim 5, wherein the installation kit further comprises a junction box unit with an electrical box having a bottom portion that including side plates that form a semi-rectangular aperture with tab indentations that allows the LED driver circuit to pass through the semi-rectangular aperture with the snap or spring clip structures engaging the tab indentations, thereby securing the LED light fixture onto the electrical box, the junction box unit further comprising arm flanges that are hingably attached to opposed sides of the electrical box and configured to pass through a recess hole on a ceiling or wall and thereby securing the LED light fixture in place by sandwiching portions of the ceiling or wall around the recessed hole between ends of the flange arms and portions of the top surface of the flattened body.

8. The LED light system of claim 5, further comprising a diffuser lens positioned over the array of LEDs.

9. The LED light system of claim 5, wherein the flattened body of the LED light fixture is round and the LED driver box includes quick connect features for electrically coupling the LED light fixture to power wiring.

10. A LED light system comprising:

a) a LED light fixture comprising:

i) a flattened body with a top surface and a bottom surface;

ii) a LED driver circuit;

iii) an array of LEDs electrically coupled to the LED driver circuit and positioned on or around the bottom surface of the flattened body; and iv) snap or spring clip structures protruding upward form the top surface of the flattened body; and b) an installation kit with a junction box unit comprising:

i) an electrical box having a bottom portion that includes side plates that form an aperture with tab indentations to allow the snap or spring clip structures engaging the tab indentations, thereby securing the LED light fixture onto the electrical box; and ii) arm flanges that are hingably attached to opposed sides of the electrical box and configured to pass through a recess hole on a ceiling or wall and thereby securing the LED light fixture in place by sandwiching portions of the ceiling or wall around the recessed hole between ends of the flange arms and portions of the top surface of the flattened body.

11. The LED light system of claim 10, wherein the installation kit further comprises a set of hook clips each having an elongated body with an L-shaped bottom portion and a top curved hook structure bending in an opposite direction relative to the L-shaped bottom portion, wherein the L-shaped bottom portion fits into portions of the slip tabs such that the top curved hook structure engages a recessed light canister housing to secure the LED light fixture thereto.

12. The LED light system of claim 10, wherein the installation kit further comprises a junction box face-plate with sets of elongated and curved fenestrations or cutouts for coupling to a junction box and a semi rectangular cutout with tab indentations that allow the LED driver box to pass through the semi-rectangular cut out with the snap or spring clip structures engaging the tab indentations, thereby securing the LED light fixture onto the junction box.

13. The LED light system of claim 10, further comprising a diffuser lens positioned over the array of LEDs.

14. The LED light system of claim 10, wherein the flattened body of the LED light fixture is round and the LED driver box includes quick connect features for electrically coupling the LED light fixture to power wiring.

* * * * *